US006945806B1

(12) United States Patent
Hsieh

(10) Patent No.: US 6,945,806 B1
(45) Date of Patent: Sep. 20, 2005

(54) FOLDING LAMP ROD AND JUNCTION BOX STRUCTURE

(76) Inventor: Pi-hua Hsieh, No. 18, Ping-Ho 10 street, Lug-Ping Li, Changhua City (TW)

( * ) Notice: Subject to any disclaimer, the term of this patent is extended or adjusted under 35 U.S.C. 154(b) by 0 days.

(21) Appl. No.: 10/838,194

(22) Filed: May 5, 2004

(51) Int. Cl.[7] ..... H01R 13/627; F21S 8/06
(52) U.S. Cl. ..... 439/351; 362/405
(58) Field of Search ..... 439/351, 11, 31, 439/336, 529, 296, 338–341; 362/405

(56) References Cited

U.S. PATENT DOCUMENTS

| | | | | |
|---|---|---|---|---|
| 3,735,329 | A * | 5/1973 | Funabashi et al. | 439/323 |
| 4,079,244 | A * | 3/1978 | Bortoluzzi | 362/405 |
| 6,183,222 | B1 * | 2/2001 | Izzo et al. | 417/423.14 |
| 6,682,303 | B2 * | 1/2004 | Wu | 416/5 |
| 6,712,491 | B1 * | 3/2004 | Wu | 362/427 |
| 6,715,906 | B1 * | 4/2004 | Wu | 362/405 |
| 6,840,651 | B2 * | 1/2005 | Wu | 362/226 |
| 2004/0151001 | A1 * | 8/2004 | Wu | 362/405 |

FOREIGN PATENT DOCUMENTS

JP 52-42681 * 4/1977

* cited by examiner

*Primary Examiner*—Michael C. Zarroli
(74) *Attorney, Agent, or Firm*—Troxell Law Office, PLLC

(57) ABSTRACT

A folding lamp rod and junction box structure in which the connector block has an access opening in its the top surface and, furthermore, the free extremity of an elastic tab at the side of the access opening extends into the access opening. A matching sawtooth-shaped inset section angles upward from the top surface at the end of the connector block and, furthermore, after the inset section is inserted into the mounting base socket, a spring at the mounting base top surface is pushed slightly upward, the rebound force of the spring then directed against the connector block to retain it while plugged into the mounting base. A threaded hole is tapped in the side of the mounting base and, furthermore, an elongated hole along the side of the connector block is aligned with the mounting base threaded hole position, providing for the penetration of the screw through both the mounting base and the connector block such that before the complete insertion of the connector block into the mounting base, the lamp rod can be rotated a suitable angle to thereby reduce the space occupied by the lamp rods and the junction box during shipment. As a result, after user purchase, it is only necessary to insert both the lamp rod and the connector block into the junction box mounting base for utilization.

3 Claims, 5 Drawing Sheets

FOLDING LAMP ROD AND JUNCTION BOX STRUCTURE

BACKGROUND OF THE INVENTION

1) Field of the Invention

The invention herein relates to a folding lamp rod and junction box structure in which the connector block has an access opening in its the top surface and, furthermore, the free extremity of an elastic tab situated at the side of the access opening extends into the access opening. A matching sawtooth-shaped inset section angles upward from the top surface at the end of the connector block and, furthermore, after the inset section is inserted into the mounting base socket, a spring at the mounting base top surface is pushed slightly upward, the rebound force of the spring then directed against the connector block to retain it while plugged into the mounting base. A threaded hole is tapped in the side of the mounting base and, furthermore, an elongated hole along the side of the connector block is aligned with the mounting base threaded hole position, providing for the penetration of the screw through both the mounting base and the connector block such that before the complete insertion of the connector block into the mounting base, the lamp rod is can be rotated a suitable angle to thereby reduce the space occupied by the lamp rods and the junction box during shipment. As a result, after user purchase, it is only necessary to insert both the lamp rod and the connector block into the junction box mounting base for utilization.

2) Description of the Prior Art

Lamps now in demand are models of reduced dimensions that have lower shipping costs and, furthermore, provide for user safety and convenient assembly, with such features indispensable for raising market competitiveness. However, in order to prevent electrocution hazards, conventional products are typically delivered from the manufacturer with the light bulb sockets on the lamp rods pre-wired in advance, which significantly enlarges packaging dimensions and increases shipping costs. Furthermore, during user assembly and installation, since the light bulb sockets and the junction box are already wired, separation is not possible. As the light bulb sockets and the junction box are in a permanent arrangement such that the angle between the light bulb sockets and the junction box cannot be further adjusted, this also results in higher shipping expenditures.

To enable the examination committee a further understanding of the structure, features, capabilities, and practical objectives of the folding lamp rod and junction box structure for lamps herein, the brief description of the drawings below is followed by the detailed description of the invention herein.

DETAILED DESCRIPTION OF THE INVENTION

Figure 1:
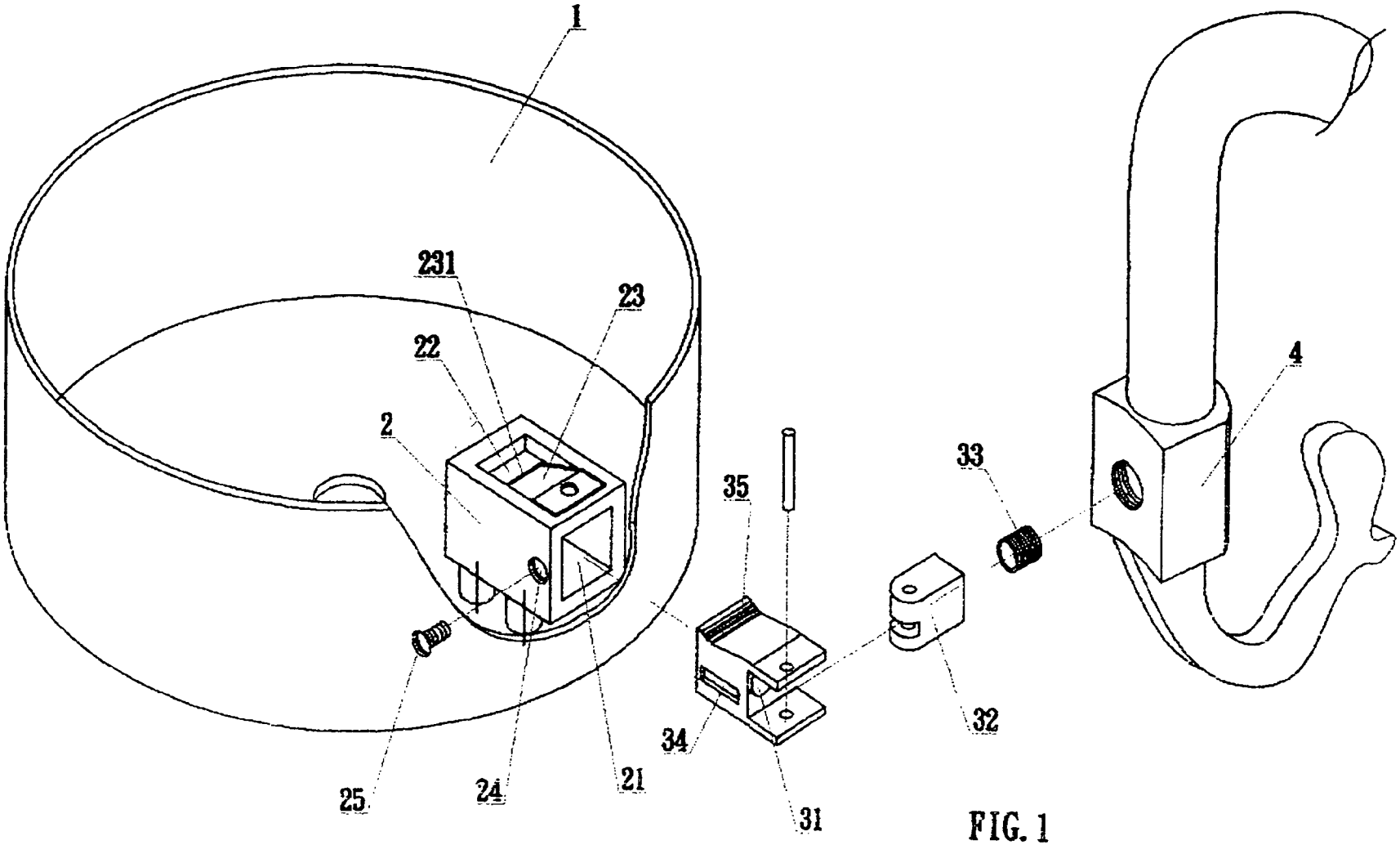
FIG. 1 is an exploded drawing of the invention herein.

Referring to FIG. 1, FIG. 2, FIG. 3, and FIG. 4, the structural arrangement of the invention herein is comprised of a mounting base 2 disposed in the interior section of a junction box 1, a connector block 3 that is plugged into the mounting base 2, and a lamp rod 4 pivotably coupled to the connector block 3, wherein:

The said junction box 1 has a plurality of ports 11 arrayed along the plane of its circumference that provide for lamp rod 4 insertion.

The said mounting base 2 has a socket 21 aligned with the junction box 1 port 21, an access opening 22 is formed through the top surface of the mounting base 2 and, furthermore, a pointed elastic tab 23 is situated at the side of the access opening 22, the free extremity 231 of the pointed elastic tab 23 extending slightly into the connector block 3 inside the access opening 22 to maintain the post-insertion distance of an inset section 35 from the end of the access opening 22 and thereby provide for the inserted engagement of the connector block 3; and a threaded hole 24 is tapped in the side of the mounting base 2 and, furthermore, a screw 25 is pre-fastened into the threaded hole 24.

Figure 2:
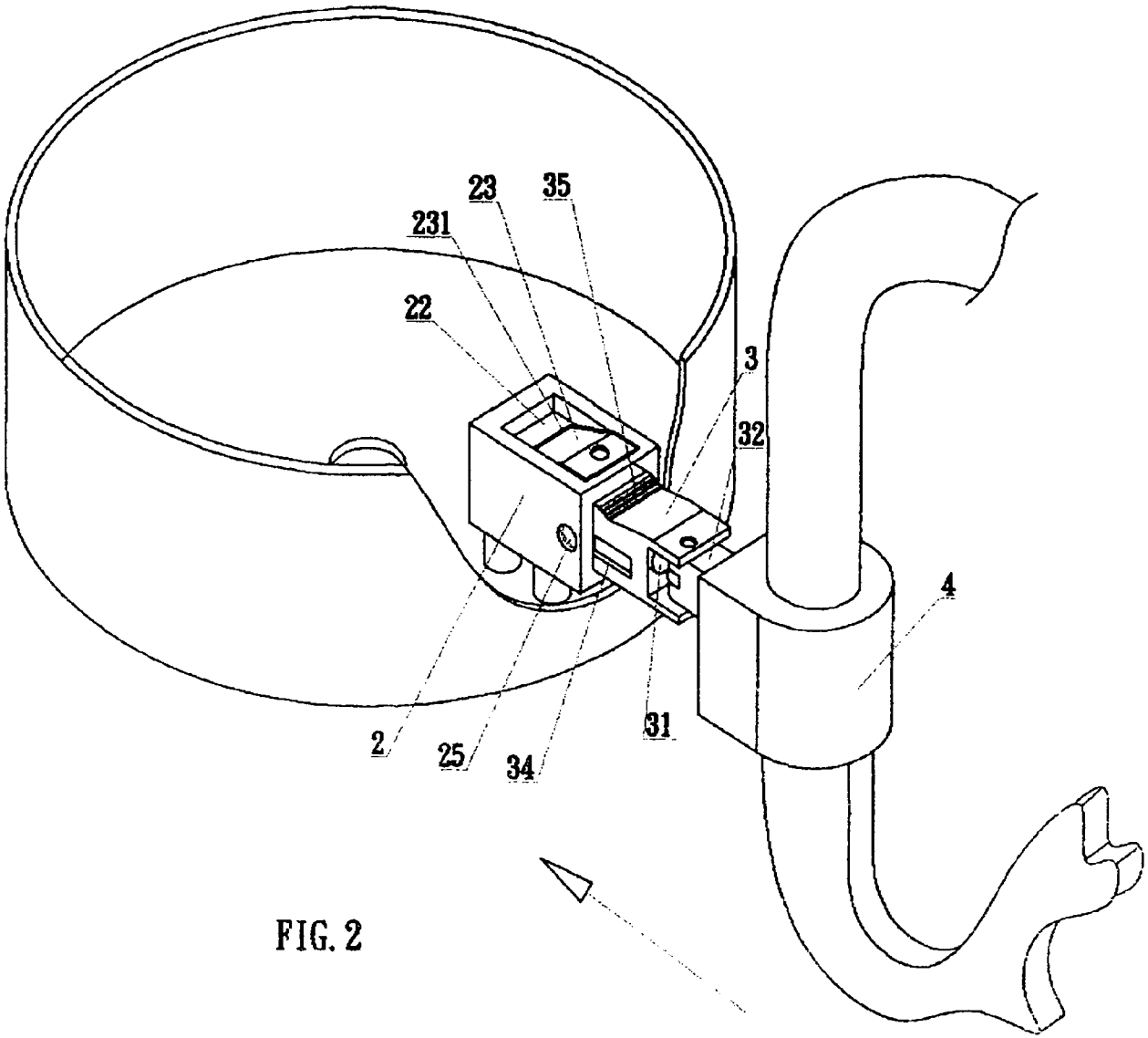
FIG. 2 is an isometric drawing of the invention herein.

The said connector block 3 has a wiring passage 31 through the center and, furthermore, a hinge block 32 is linked to the front end of the connector block 3, a threaded tube 33 at the outer lateral end of the said hinge block 32 is fastened to the lamp rod 4, an elongated hole 34 along the side is aligned with the mounting base 2 threaded hole 24 position and, furthermore, the screw 25 fastened into the outer side of the mounting base 2 penetrates the connector block 3 elongated hole 34 and before the complete insertion of the connector block 3 into the mounting base 2, the screw 25 is pre-positioned in the connector block 3 and prevented from dislodging out of the connector block 3 (as shown in FIG. 2); the sawtooth-shaped inset section 35 angles upward from the top surface at the end of the connector block 3 and, furthermore, after the inset section 35 is inserted into the mounting base 2 socket 21, a spring 233 at the mounting base 2 top surface is pushed slightly upward, the rebound force of the spring 233 then directed against the connector block 3 to retain it while plugged into the mounting base 2.

Figure 3:
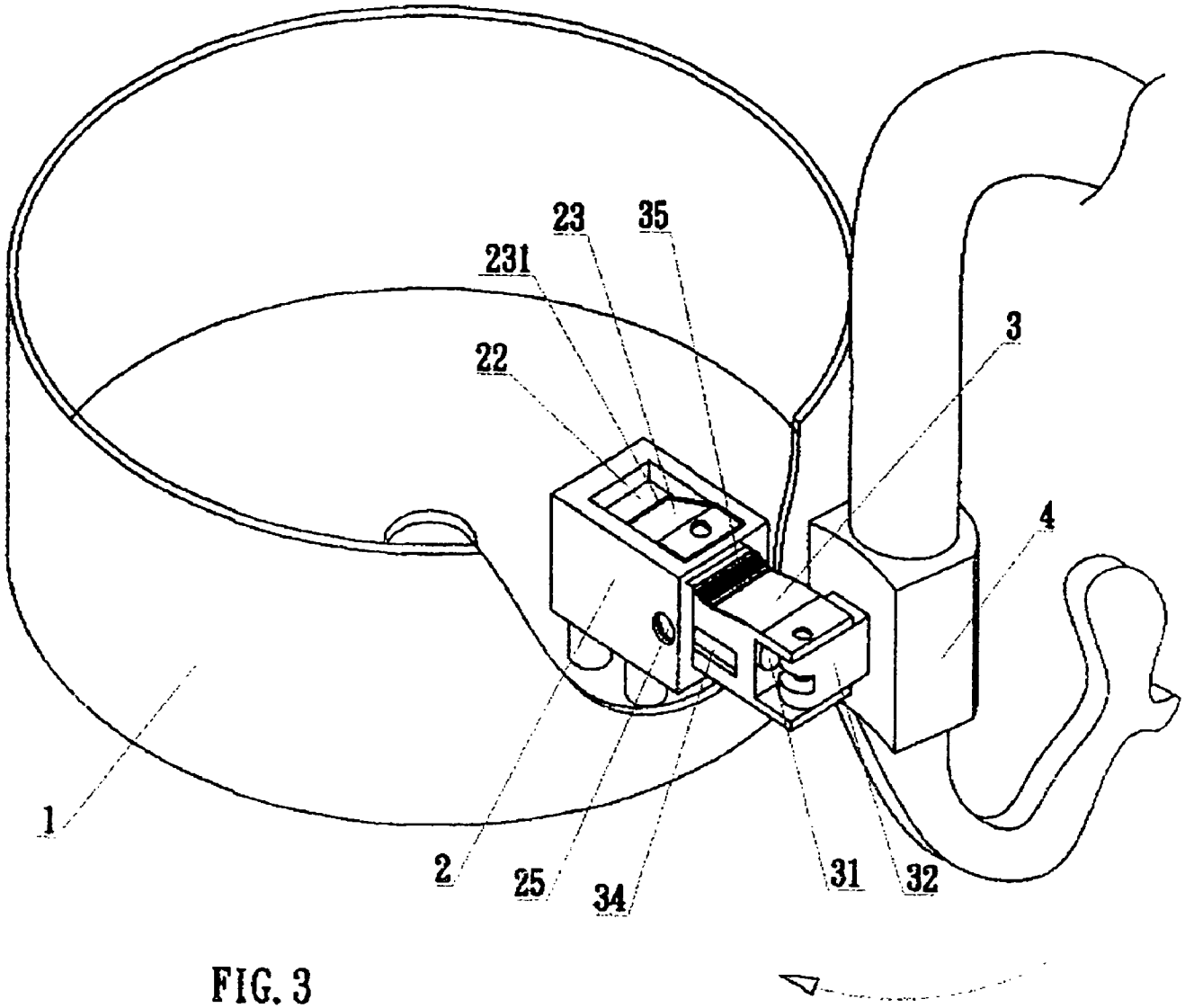
FIG. 3 is an isometric drawing of the lamp rod in the rotated state.
Figure 4:
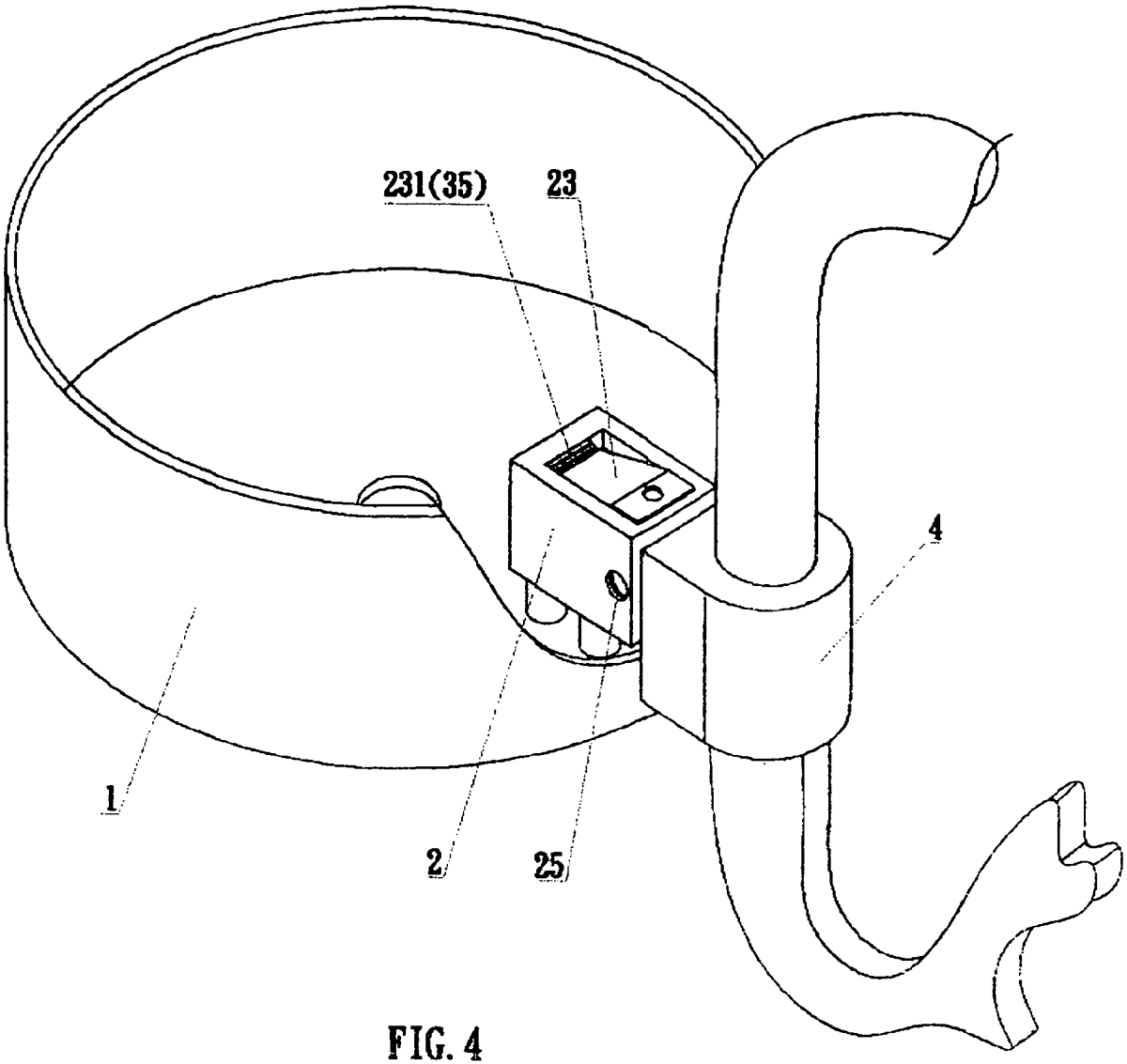
FIG. 4 is an isometric drawing of the lamp rod and the junction box in the inserted state.
Figure 5:
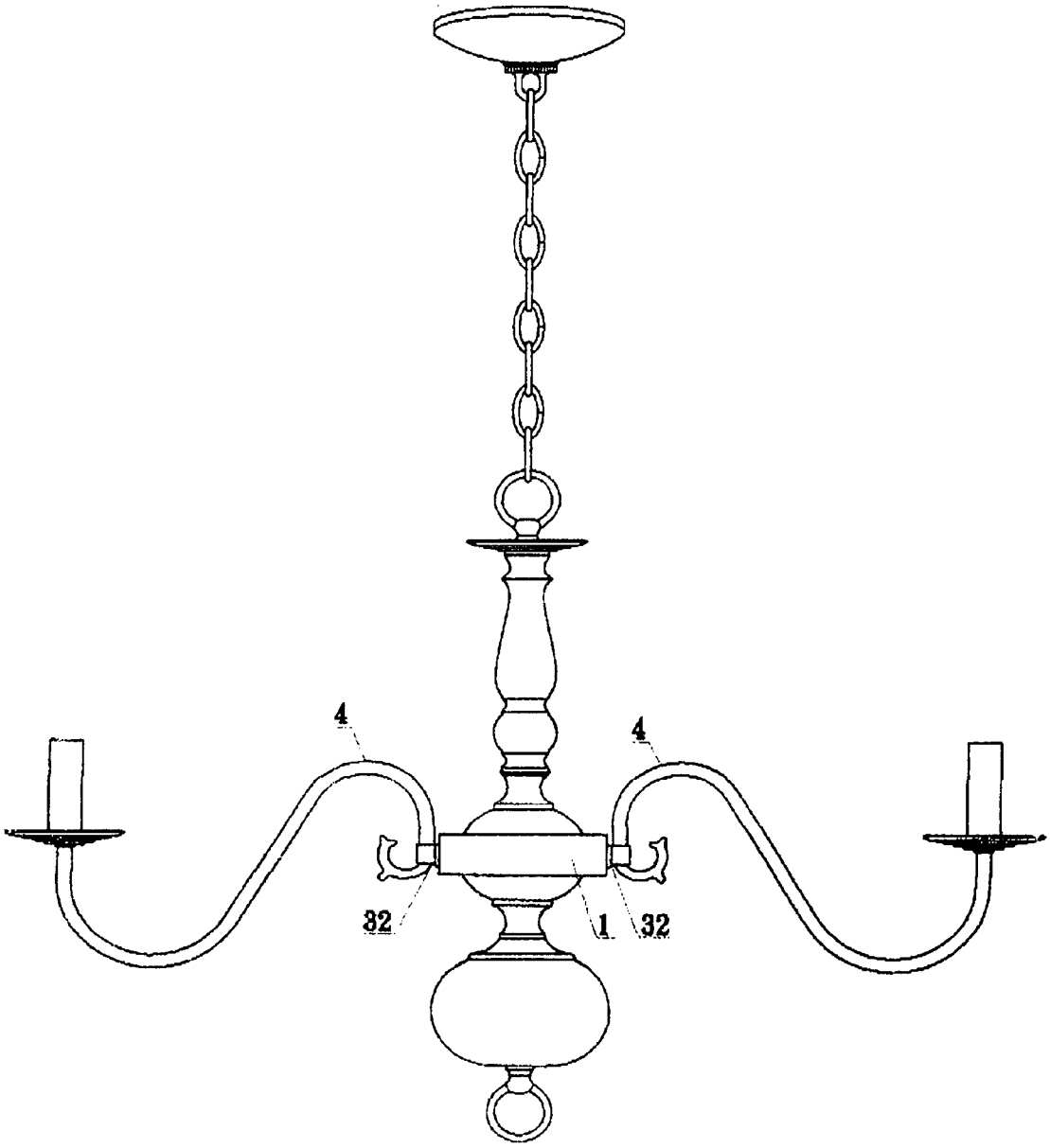
FIG. 5 is an orthographic drawing of a fully assembled lamp embodiment.

Referring to FIG. 3 and FIG. 4, the hinge block 32 is linked to the front end of the connector block 3 and, furthermore, the threaded tube 33 at the opposite end of the hinge block 32 is fastened to the lamp rod 4, when packaged during shipment, the said connector block 3 is not plugged into the mounting base 2, and only the screw 25 in the threaded hole 24 at the side of the mounting base 2 and penetrating the elongated hole 34 keeps the connector block 3 at the mounting base 2 front end, enabling the lamp rod 4 hinged onto the connector block 3 to be rotated a suitable angle as required to thereby reduce packaging and shipping material dimensions (as shown in FIG. 3); and after user purchase, it is only necessary to insert both the lamp rod 4 and the connector block 3 into the junction box 1 mounting base 2, enabling the engagement of the inset section 35 on the connector block 3 onto the mounting base 2 elastic tab 23, thereby positioning the lamp rod 4 at the side of the junction box (as shown in FIG. 4) and, as such, further reducing the space occupied by the lamp rod 4 and the junction box 1 during shipment.

What is claimed is:

1. A folding lamp rod and junction box structure, the invention herein comprised of a mounting base disposed in the interior section of a junction box, a connector block that is plugged into the said mounting base, and a lamp rod pivotably coupled to the said connector block, wherein:

The said junction box has a plurality of ports arrayed along the plane of its circumference that provide for the insertion of the said lamp rod, The said mounting base has a socket aligned with the said junction box port, an access opening is formed through the top surface of the said mounting base and, furthermore, a pointed elastic tab is situated at the side of the said access opening, the free extremity of which extends slightly into the said connector block access opening, and a threaded hole is tapped the side of the said mounting base and, furthermore, a screw is pre-fastened into the said threaded hole, The said connector block has a wiring passage through the center and, furthermore, a hinge block is linked to the front end of the said connector block, a threaded tube is situated at the outer lateral end of the said hinge block, an elongated hole along the side is aligned with the said mounting base threaded hole position, providing for the penetration of the said screw through the said connector block such that before the complete insertion of the said connector block into the said mounting base, the said screw is pre-positioned in the said connector block and prevented from dislodging out of the said connector block; and a sawtooth-shaped inset section angles upward from the top surface at the end of the said connector block and, furthermore, after the said inset section is inserted into the said mounting base socket, a spring at the mounting base top surface is pushed slightly upward, the rebound force of the said spring then directed against the said connector block to retain it while plugged into the said mounting base.

2. As mentioned in claim 1 of the folding lamp rod and junction box structure of the invention herein, when packaged during shipment, the said connector block is not plugged into the said mounting base, and only the said screw in the said threaded hole at the side of the said mounting base and penetrating the said elongated hole keeps the said connector block at the front end of the said mounting base, enabling the said lamp rod hinged onto the said connector block to be rotated a suitable angle as required to thereby reduce packaging and shipping material dimensions; and after user purchase, it is only necessary to insert both the said lamp rod and the said connector block into the said junction box mounting base, enabling the engagement of the said inset section on said the connector block onto the said mounting base elastic tab.

3. As mentioned in claim 1 of the folding lamp rod and junction box structure of the invention herein, the said connector block inset section is maintained at a post-insertion distance between the said mounting base elastic tab and the end of the said access opening.

* * * * *